US007640853B2

(12) United States Patent
Pera et al.

(10) Patent No.: US 7,640,853 B2
(45) Date of Patent: Jan. 5, 2010

(54) PRESSES FOR MATTERS SUCH AS THE GRAPE HARVEST

(75) Inventors: Xavier Pera, Sete (FR); Jean Pera, Agde (FR)

(73) Assignee: Le Materiel Pera, Florensac (FR)

( * ) Notice: Subject to any disclaimer, the term of this patent is extended or adjusted under 35 U.S.C. 154(b) by 0 days.

(21) Appl. No.: 12/276,860

(22) Filed: Nov. 24, 2008

(65) Prior Publication Data

US 2009/0133590 A1 May 28, 2009

(30) Foreign Application Priority Data

Nov. 23, 2007 (FR) ..... 07 59280

(51) Int. Cl.
*B30B 5/02* (2006.01)
*B30B 9/22* (2006.01)

(52) U.S. Cl. ..... 100/116; 100/71; 100/211

(58) Field of Classification Search ..... 100/71, 100/104, 107, 110, 116, 125, 126, 211; 99/495; 210/350, 351

See application file for complete search history.

(56) References Cited

U.S. PATENT DOCUMENTS 4,438,690 A * 3/1984 von Allworden ..... 100/116
4,607,570 A * 8/1986 Hauser ..... 100/116
4,962,881 A 10/1990 Otsuki
5,094,158 A 3/1992 Melandri
5,451,415 A * 9/1995 Pera et al. ..... 426/489
6,247,397 B1 * 6/2001 Diotalevi ..... 100/71

FOREIGN PATENT DOCUMENTS

| | | |
|---|---|---|
| DE | 102004023761 | 12/2005 |
| FR | 2812235 | 2/2002 |
| FR | 2873617 | 2/2006 |
| JP | 02026639 | 1/1990 |
| NL | 7700253 | 8/1977 |
| NL | 7807959 | 2/1979 |
| WO | 2004033192 | 4/2004 |
| WO | 2005051642 | 6/2005 |

OTHER PUBLICATIONS

Priority Search Report dated Jul. 8, 2008, in French Priority.

* cited by examiner

*Primary Examiner*—Jimmy T Nguyen
(74) *Attorney, Agent, or Firm*—Young & Thompson

(57) ABSTRACT

A rotary cage press provided internally with a deformable flexible membrane having the form of a half of the cage, this press being characterized in that the elements of recovering the liquid part of the matter include on the cage, at least one external racking device, and a connection unit through which opens out the outlet orifice of the racking device; and on the chassis, a liquid taking device including a telescopic tubular unit allowing a retracted position in which the telescopic unit presents no obstacle to the rotation of the cage and an extended position in which the telescopic unit is adapted, when the cage is in a predetermined pressing angular position, to come against the connection unit bearing in a seal-tight manner around the outlet orifice of the racking device.

16 Claims, 3 Drawing Sheets

PRESSES FOR MATTERS SUCH AS THE GRAPE HARVEST

FIELD OF THE INVENTION

The invention is directed to presses for separating the solid and liquid parts of matter such as fruit, in particular the grape harvest.

BACKGROUND OF THE INVENTION

Already known, notably through the French patent applications 2 812 235 and 2 873 617, is such a press which comprises:

- a cage presenting a cylindrical lateral wall and two flanges closing said cage respectively at one end and at the other end of said lateral wall;
- means of mounting said cage to rotate about its axis in a position where the latter is positioned horizontally, comprising a chassis;
- means for selectively controlling the rotation of said cage about its axis;
- a deformable flexible membrane positioned in said cage, fixed in a seal-tight manner to the lateral wall of the cage along two opposite longitudinal edges and fixed in a seal-tight manner to the flanges along two respective transversal edges each situated between an end of one longitudinal edge and an end of the other longitudinal edge so that said membrane separates the internal volume of said cage into a pressing chamber delimited by said membrane, by a first half of said lateral wall situated between said two opposite longitudinal edges and by a first half of each of said flanges situated, relative to the respective transversal edges, on the side of the first half of the lateral wall, and into a control chamber delimited by said membrane, by the second half of said lateral wall and by the second half of said flanges, said flexible membrane, at rest, having almost the form of half of the cage;
- means of admitting a pressure agent into said control chamber and means of sucking said pressure agent out of said control chamber;
- at least one door blocking or revealing an opening provided in said first half of the lateral wall of the cage;
- drainage means equipping said first half of the lateral wall of the cage; and
- means of recovering said liquid part of the matter leaving the pressing chamber via said drainage means.

Before filling the pressing chamber with matter such as the grape harvest, means of sucking the pressure agent out of the control chamber are actuated, so that a vacuum is produced therein and the membrane is against the second half of the lateral wall and the flanges of the cage.

To produce the pressing, once filling is complete, means of admitting a pressure agent into the control chamber are actuated, so that the matter that is present therein is applied against the drainage means and pressurized, with the result that the liquid part of this matter flows through the drainage means. In general, several phases of pressing the matter such as grape harvest are carried out, the pressing phases being separated by press-cake breaking-up phases in which the cage is rotated about its axis to dislodge the cake of matter that is formed under the effect of the pressure.

To empty the cage once the pressing is complete, the door is opened and the cage rotated so that the solid part remaining in the pressing chamber is gradually evacuated through the orifice revealed by the door.

To avoid damaging the membrane, the vacuum is formed in the control chamber in the press-cake breaking-up phase and in the emptying phase.

SUMMARY OF THE INVENTION

The invention aims to increase the possibilities of use of such a press.

The press according to the invention is characterized in that the means of recovering the liquid part of the matter comprise:

- on the cage, at least one external racking device, and a connection unit through which opens out the outlet orifice of the racking device; and
- on said chassis, a liquid taking device comprising a telescopic tubular unit having a retracted position in which said telescopic unit presents no obstacle to the rotation of the cage and an extended position in which said telescopic unit is adapted, when the cage is in a predetermined pressing angular position, to come against said connection unit in a seal-tight bearing manner about the outlet orifice of the racking device.

Thus, in the extended position, the telescopic tubular unit is connected to the racking device and can guide the liquid flowing from the latter towards a tank for receiving the liquid part.

The press according to the invention offers the advantage of making it possible, in a simple, convenient and cost-effective manner, to recover the liquid part leaving the press without this liquid part coming into contact with the air, which is particularly useful when this liquid part is sensitive to oxidation, for example when the matter is the grape harvest to be made into white wine.

If required, the press according to the invention can be used conventionally with a matter of which the liquid part can stand contact with the air, for example the grape harvest to be made into red wine, the liquid part then being conventionally recovered in a tank positioned on the ground which receives the liquid part falling by gravity from the outlet orifice of the racking device or devices.

It will be observed that, given in particular the absence of revolving gasket, it is relatively simple to convert an already existing conventional press into a press according to the invention, by adding a unit for connecting to the racking device and by adding the liquid taking device.

According to characteristics that are preferred for reasons of simplicity, convenience and cost-effectiveness, both in production and in use:

- said connection unit is a plate projecting radially from the lateral wall whereas said telescopic unit comprises an annular sealing gasket by which said telescopic unit is adapted to come into contact against said plate around said outlet orifice;
- said liquid sampling device comprises a guide bushing whereas said telescopic tubular unit is a slide engaged in said bushing with respect to which it slides, the liquid taking device comprising a jack to displace said slide between said retracted position and said extended position;
- said slide comprises a straight tubular portion engaged in said bushing and provided at one end with a head by which said slide is adapted to bear against said connection unit;
- said head comprises a ring linked to said straight tubular portion and a sealing annular gasket supported by said ring on the side opposite to said tubular portion;

said liquid taking device comprises a bellows positioned between said guide bushing and said head;

said slide comprises, in addition to said straight tubular portion, called first straight tubular portion, a second straight tubular portion oriented transversally to the first tubular portion and extending from the latter to a coupling for a flexible pipe;

said racking device comprises a pipe in communication with said drainage means and a valve positioned between said pipe and said outlet orifice;

said drainage means comprise a plurality of perforated gutters and link means between said perforated gutters, said racking device being in communication with a space delimited by said lateral wall and by the gutter which is the lowest in said predetermined pressing angular position;

the press comprises a plurality of said racking devices;

said recovery means also comprise a tank positioned on the ground vertically in line with said outlet orifice; and/or the press comprises an assembly for allowing inert gas into said pressing chamber.

BRIEF DESCRIPTION OF THE DRAWINGS

The disclosure of the invention will now be continued with the description of a preferred exemplary embodiment, given hereinbelow by way of illustration and in a non-limiting way, with reference to the appended drawings. In the latter.

DETAILED DESCRIPTION OF THE INVENTION

Figure 1:
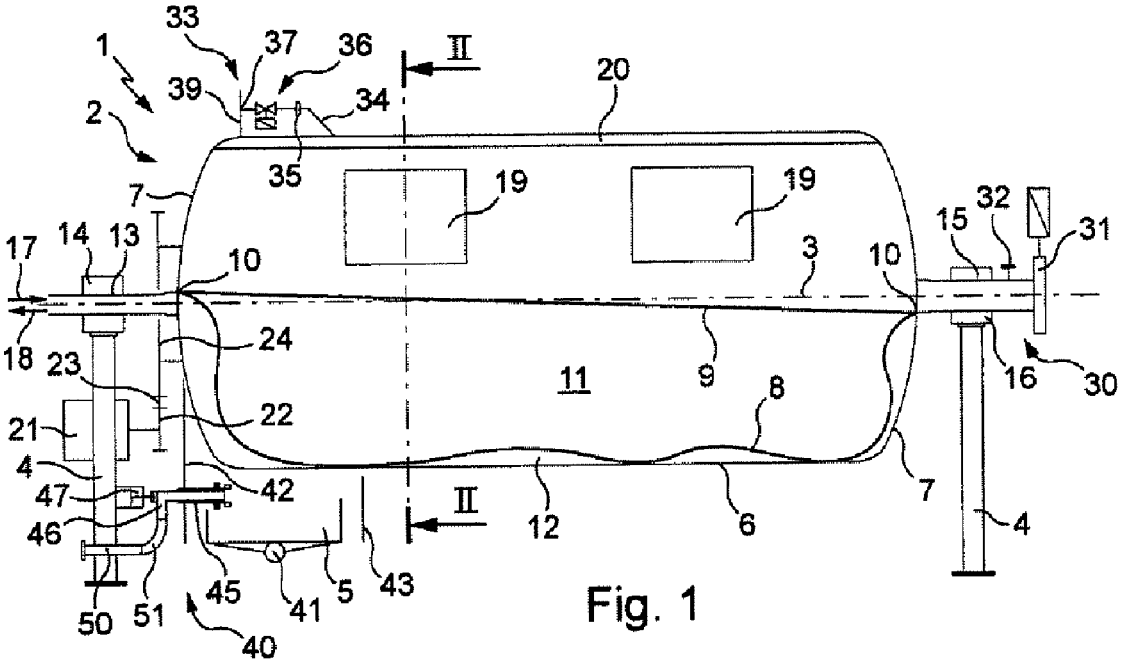
FIG. 1 is a diagrammatic view in cross-sectional elevation of a press according to the invention, the membrane being in the rest position, this view being taken as indicated by I-I in FIG. 2.

The press 1 illustrated in the drawings comprises a cage 2 mounted to rotate about its axis 3 on posts 4 resting on the ground.

Under the cage 2 and on the side that can be seen to the left in FIG. 1, there is a tank 5 for recovering the liquid part of the matter being processed, in this case for recovering the grape juice when this matter is the grape harvest. There is also provided, for the case where there is a desire to avoid allowing the liquid to make contact with the air, notably if it is grape juice to be made into white wine, a liquid taking device 40.

The cage 2 presents a cylindrical lateral wall 6 and two flanges 7 closing the cage 7 respectively at one end and at the other end of the lateral wall 6.

Inside the cage 2 there is a deformable flexible membrane 8 (not represented in FIGS. 3 and 4), fixed in a seal-tight manner, on the one hand, to the lateral wall 6 along two opposite longitudinal edges 9 and, on the other hand, to the flanges 7 along two respective transversal edges 10 each situated between an end of one edge 9 and an end of the other edge 9, the membrane 8, at rest (FIGS. 1 and 2), having somewhat the form of a half of the cage 2.

The internal volume of the latter is subdivided by the membrane 8 into a pressing chamber 11 and a control chamber 12.

Figure 2:
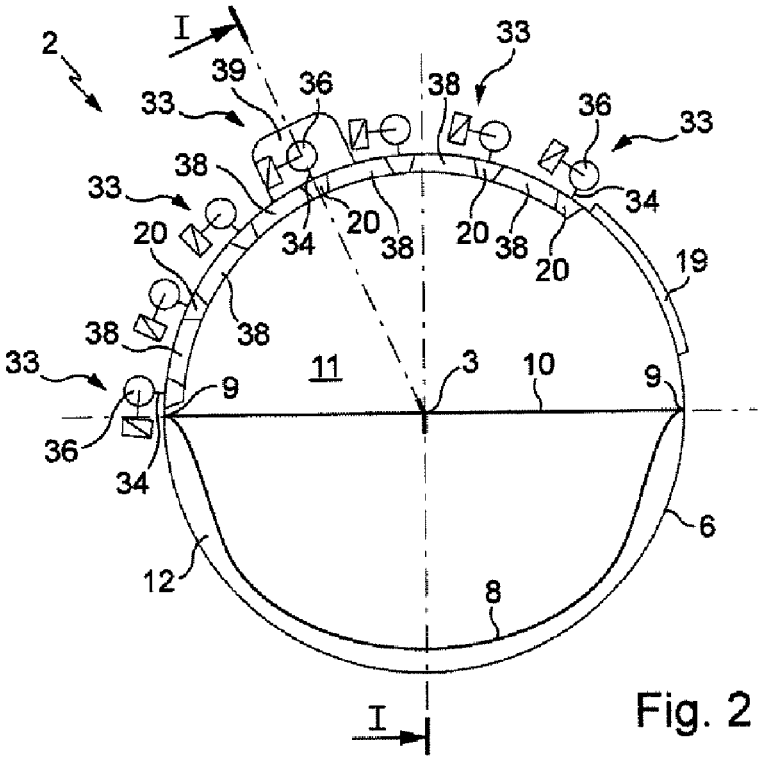
FIG. 2 is a diagrammatic view in cross-sectional elevation taken in the cage of the press as indicated by II-II in FIG. 1.

The pressing chamber 11 is delimited by the membrane 8, by the half of the lateral wall 6, situated between the longitudinal edges 9, that can be seen at the top in FIGS. 1 and 2, and by the half of each of the flanges 7 that can be seen above the transversal edges 10 in FIGS. 1 and 2.

As for the control chamber 12, it is delimited by the membrane 8 and by the other half of the lateral wall 6 and of the flanges 7.

To enable the cage 2 to be mounted to rotate on the posts 4, the cage 2 comprises, at the center of each of the flanges 7, respectively a journal 13 cooperating with a bearing 14 supported by the posts 4 that can be seen on the left in FIG. 1 and a journal 15 cooperating with a bearing 16 supported by the posts 4 that can be seen on the right.

In the example illustrated, the journal 13 serves as a nozzle for the control chamber 12 with which it communicates.

The nozzle 13 allows either the suction of the air that is contained in the chamber 12, or the admission into this chamber of compressed air, the connection and the pipelines connected to the nozzle 13 and the compressor and the vacuum pump making it possible to admit and suck out compressed air being symbolized in FIG. 1 by the arrows 17 and 18 respectively.

Just as the journal 13 serves as a nozzle for the control chamber 12, the journal 15 serves as a nozzle for the pressing chamber 11, with which it is in communication. Opposite from tank 2, the nozzle 15 is extended by an assembly 30 comprising a pneumatic valve 31 and a coupling 32 for a link pipe to an inert gas source, the valve 30 being used to open or close the passage between the coupling 31 and the nozzle 15.

To allow the introduction of the matter to be pressed into the chamber 11 and, after pressing, the evacuation of the solid part of this matter, the lateral wall 6 is provided with two openings, each of which can be blocked by a door 19.

To allow for the separation between the solid and liquid parts of the matter introduced into the pressing chamber 11, the lateral wall 6 is fitted with perforated gutters 20, in this case seven of them, which make it possible to drain this matter as explained later.

Whereas each of the gutters 20 is perforated, each portion of the wall 6 situated in line with a gutter 20 is solid.

Figure 3:
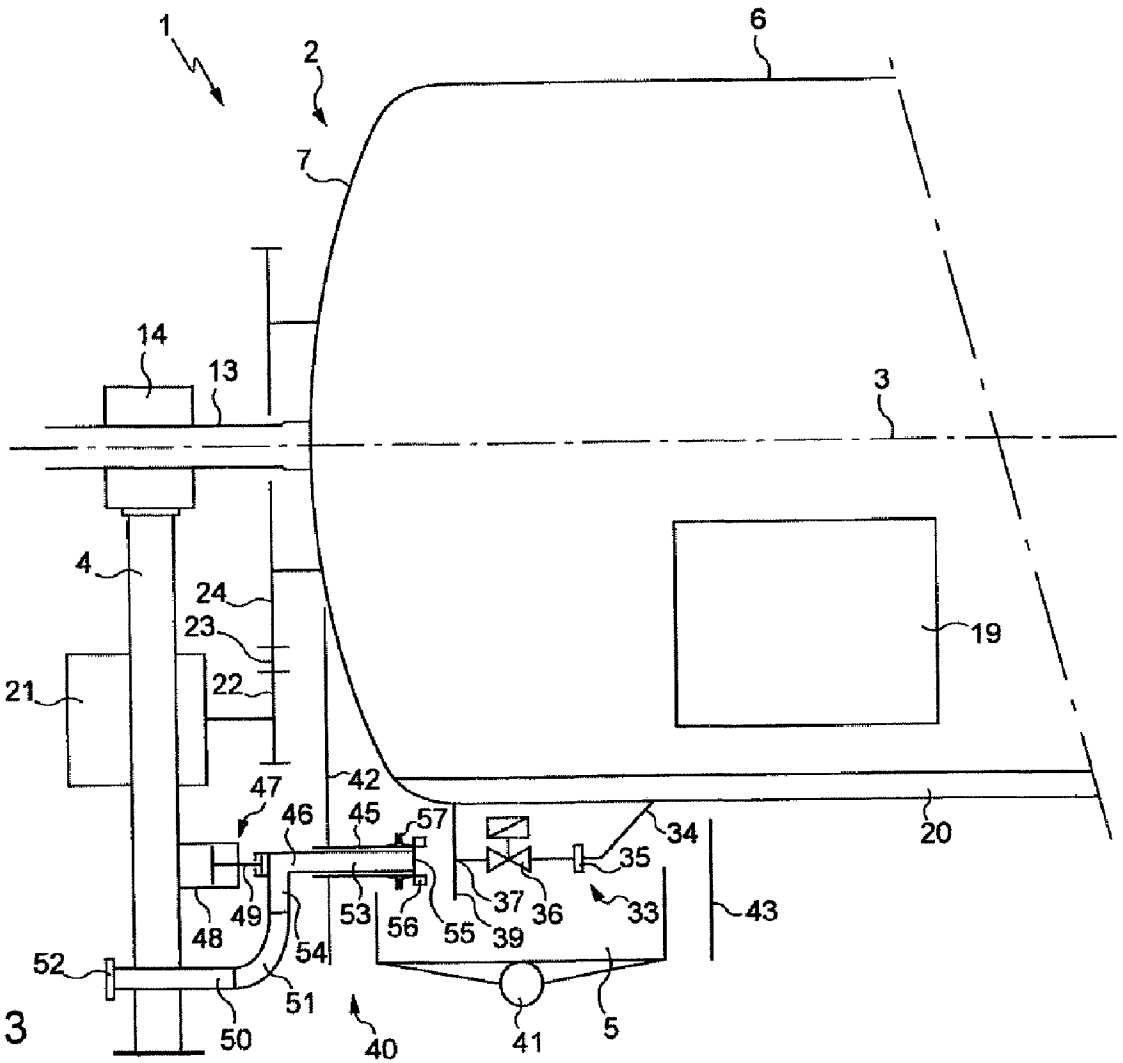
FIG. 3 is an enlarged view similar to the part of FIG. 1 that can be seen on the left, the cage being in a different angular position, in which the matter is being pressed.
Figure 4:
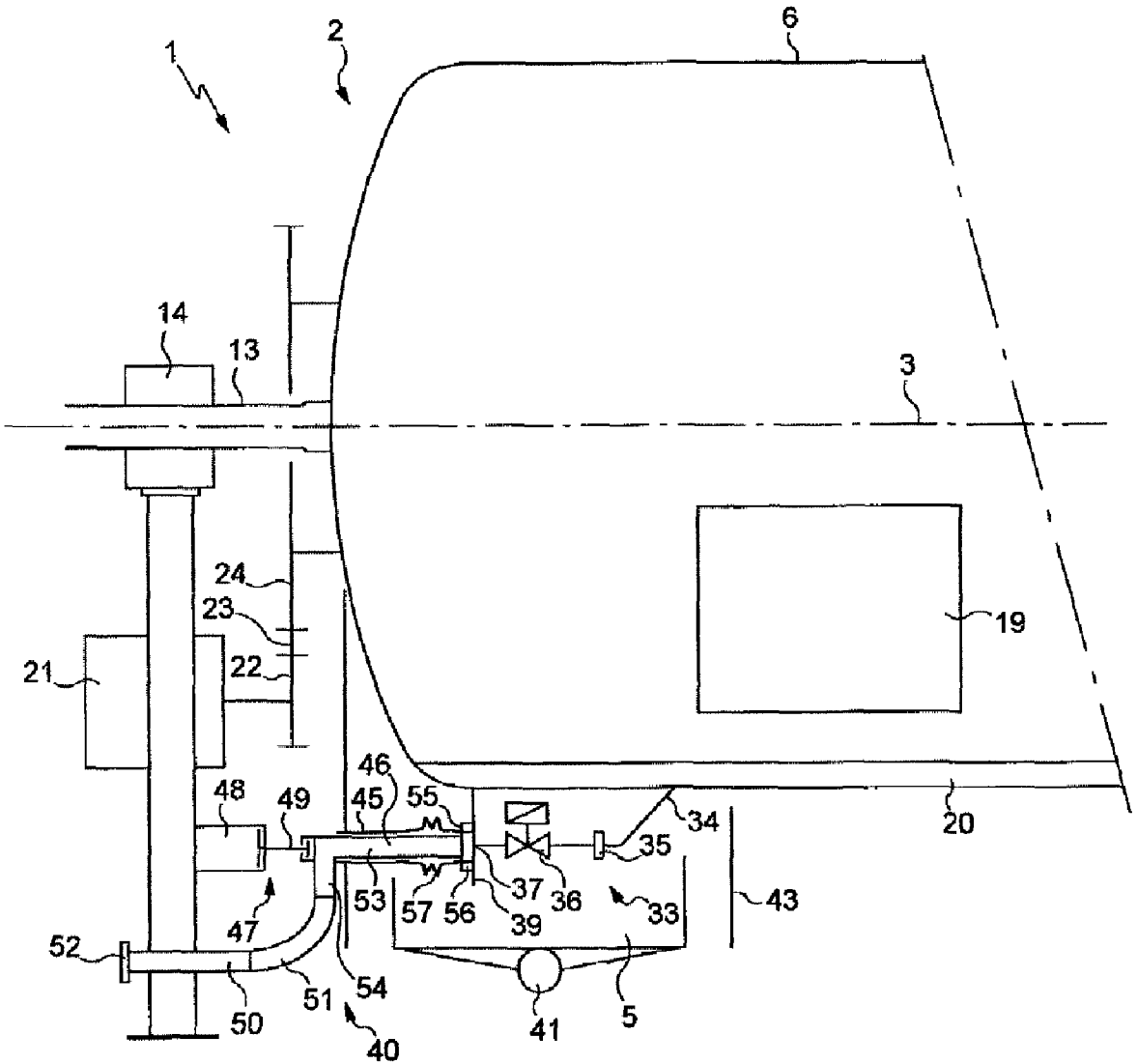
FIG. 4 is a view similar to FIG. 3, but in which the liquid taking device is in the extended position in order to receive the juice flowing from the cage.

For each space delimited by the wall 6 and by a gutter 20, the liquid is evacuated out of the cage 2 by a racking device 33 positioned outside the lateral wall 6 at the end of the cage 2 that can be seen on the left in FIGS. 1, 3 and 4. Each device 33 comprises a pipe 34 in communication with the space delimited by the wall 6 and a gutter 20, the distal end of the pipe 34 forming a coupling 35 on which is mounted a pneumatic valve 36 of which the end opposite to the coupling 35 forms the outlet orifice 37 of the racking device 33.

Between the different perforated gutters 20, there are provided pipes 38 (FIG. 2) which link them in pairs so that the liquid collected by one of the gutters 20 can join the other gutters 20 and be evacuated by any one of the racking devices 33, in particular by that associated with the perforated gutter 20 which is central, that is, the gutter 20 on either side of which there are here three other gutters 20.

The racking device 33 of the central gutter 20 is associated with a plate 39 projecting radially from the external side of the wall 6, the outlet orifice 37 of the device 33 opening out through the plate 39.

As explained later, the plate 39 serves as a unit for connecting to the liquid taking device 40.

Each of the racking devices 33, and more specifically the outlet orifice 37 of each device 33, is vertically in line with the tank 5 so that the liquid flowing from the orifice 37 is collected in the tank 5, which is fitted in the bottom part with a bung 41 to which is connected a pipe linking to a tank for receiving the liquid.

To avoid splashes when the liquid is flowing, protection walls 42 and 43 supported by the chassis of which the posts 4 form a part are provided either side of the tank.

To drive the cage 2 rotation-wise, the press 1 comprises, as can be seen in FIGS. 1, 3 and 4, an electric motor 21 supported by the posts 4 that can be seen on the left, the rotary shaft of the motor 21 being equipped with a gear 22 which engages with an intermediate gear 23, which also engages with a toothed wheel 24 mounted on the flange 7 of the cage 2 that can be seen on the left in FIGS. 1, 3 and 4, the wheel 24 being centered, like the cage 2, on the axis 3.

Before introducing matter such as the grape harvest into the chamber 11, the cage 2 is placed in a position in which the doors 19 are at the top of the cage 2, the doors 19 are opened and the suction means 18 are actuated in order to produce the vacuum in the control chamber 12, the result of this being that the membrane 8 is against the lateral wall 6 and against the flanges 7.

The matter such as the grape harvest is then introduced through the openings revealed by the doors 19, this matter, given the positioning of the openings, being distributed by itself relatively evenly in the pressing chamber 11.

Once the filling is complete, the doors 19 are closed and the cage 2 is switched from the filling position in which the doors 19 are at the top of the cage 2 to the pressing position illustrated in FIGS. 3 and 4, this angular displacement of the cage 2 being of the order of a quarter of a turn (90°).

In the pressing position, the gutter 20 that is central, that is, the gutter either side of which there are in this case three other gutters 20, is in the bottommost position of the cage 20.

When contact between the liquid part of the matter to be treated and the atmosphere presents no particular drawback, for example when it is a grape harvest that is to be made into red wine, the valve of each of the racking devices 33 is opened in the pressing position so that the liquid can flow from each of the orifices 37 and be collected in the tank 5.

When, on the other hand, there is a desire to prevent the liquid coming into contact with the atmosphere, the racking devices 33 remain closed apart from the racking device associated with the gutter 20 which is in the bottommost position, in this case the central gutter. The presence of the pipes 38 linking the gutters 20 allows all the liquid to flow through this single racking device located at the lowest point of the cage 2. The running liquid is not then collected in the tank 5 but with the device 40, as illustrated in FIG. 4 and explained below.

To force the extraction of the liquid part (pressing), for example after having allowed the liquid to flow naturally (draining), the means 17 of allowing compressed air into the control chamber 12 are actuated.

The membrane 8 is then applied against the matter introduced into the chamber 11.

Under the effect of this pressure and under the effect of gravity, the liquid part of the matter runs through the perforations of the gutters 20 and either into the recovery tank 5 through the various racking devices 33 when they are all open, or into the liquid sampling device 40 through just the device 33 situated in the lowest position, as illustrated in FIG. 4 and explained later.

Once the liquid stops flowing, the suction means 18 are actuated until the membrane 8 is once again against the lateral wall 6 and against the flanges 7. Where appropriate, if the liquid taking device 40 is used, its tubular slide 46 is brought into the retracted position.

The cage 2 is then turned for a certain time in order to break up the press-cake, that is, dislodge the cake of matter that was formed under the effect of pressure.

A certain number of pressing and press-cake breaking-up phases are then performed, then, when it is assumed that all of the liquid part of the matter has been extracted, the doors 19 are opened and the cage 2 is turned, with, of course, the membrane 8 against the lateral wall 6 and the flanges 7, so that the solid part of the matter remaining in the chamber 11 is gradually evacuated through the openings revealed by the doors 19.

As can be seen more particularly in FIGS. 3 and 4, the liquid taking device 40 comprises a guide bushing 45 oriented horizontally and fixed to the protection wall 42, a tubular slide 46 engaged in the bushing 45, a pneumatic jack 47, the body 48 of which is fixed to the posts 4 that support the motor 21 and the stem 49 of which is fixed to the slide 46, a rigid pipe 50 supported by the same posts 4, of which one end, situated outside of cage 2, is linked to the tubular slide 46 by a flexible pipe 51 while the other end of the rigid pipe 50, situated on the side opposite to the cage 2, presents a coupling 52 for a link pipe to a tank for receiving the liquid.

The slide 46 comprises two straight tubular portions positioned transversally relative to each other, respectively a relatively long portion 53, by which the slide is engaged in the bushing 45, and a relatively short portion 54, extending from the portion 53 to a coupling to which the flexible pipe 51 is fixed. The end of the portion 53 situated outside of cage 2 (end that can be seen on the right in FIGS. 1, 3 and 4) is provided with a ring 55 supporting, on the side opposite to the portion 53, an annular sealing gasket 56.

A bellows 57 is positioned between the bushing 45 and the ring 55.

The stem 49 of the jack 47 is linked to the slide 46 opposite the ring 55.

The slide 46 moves between the retracted position illustrated in FIGS. 1 and 3 and the extended position illustrated in FIG. 4, the slide 46 being driven between these two positions by the jack 47, the stem of which leaves the body 48 to move from the retracted position to the extended position, while the stem 49 returns into the body 48 to move from the extended position to the retracted position.

As can be seen in FIGS. 1 and 3, in the retracted position, the slide 46, and more specifically the head formed by the ring 55 and the gasket 56, is separate from the racking devices 33 so that the device 40 presents no obstacle to the rotation of the cage 2.

The retracted position of the slide 46 is defined by the ring 55 coming into contact with the distal end of the bushing 45, the ring 55 thus forming a stroke end stop.

The slide 46 is designed to be placed in the extended position after the cage 2 has been placed in the angular pressing position, the plate 39 then being in the lowest position of the cage 2 and facing the slide 46, and more specifically the head formed by the ring 55 and the gasket 56, the orifice 37 being centered relative to this head and to the straight portion 53.

As can be seen in FIG. 4, in the extended position, the slide 46 comes into contact via the gasket 56 with the plate 39 around the outlet orifice 37.

It is then possible to open the valve 36 of the racking device with which the plate 39 is associated, the device 40 then guiding the liquid flowing from the orifice 37 to the coupling 52.

Once the liquid stops flowing, the valve of the racking device 33 associated with the plate 39 is closed, the jack 47 is actuated to move the device 40 into the retracted position, the suction means 18 are actuated until the membrane 8 is against the lateral wall 6 and against the flanges 7 and the cage 2 can then be turned in order to perform a breaking-up of the press-cake.

When the liquid part of the matter to be treated is sensible to contact with the air, the assembly 30 makes it possible to inject an inert gas into the cage 2, this gas penetrating through the coupling 32 and into the cage 2 through the opening of the valve 31. Such an injection of gas can be performed before and/or after the filling of the cage 2 with the matter to be treated, even during the press-cake breaking-up phases.

The various actuation units of the press 1, in particular the motor 21, the valve 31, the valves 36 and the jack 47, are linked to a programmable control unit which controls their operation according to predetermined sequences that facilitate the task of the user and enable the press 1 to operate in total safety. In particular, this control unit prohibits the actuation of the motor 21 when the juice sampling device 40 is in the extended position.

It can be seen that the press 1 can equally be used with a matter of which the liquid part is sensible to contact with the air, which can provoke its oxidation, for example when the matter is the grape harvest to be made into white wine, and with a matter which can stand contact with the air, for example a grape harvest to be made into red wine.

In the latter case, the liquid taking device 40 is not used (it remains in the retracted position) and, in the pressing phases, all the racking devices 33 are opened, the liquid being collected in the tank 5.

In a variant that is not represented, in order to speed up the flow of the liquid part when the latter must be protected from the ambient air, there are provided several juice taking devices 40, for example three of them.

In another variant that is not illustrated, advantageous in the case where the speed of flow of the liquid part is of no particular importance, certain racking devices 33 are eliminated, even all of them except, of course, for the one associated with the plate 39.

In other variants that are not illustrated, the plate 39 is replaced by a connection unit that is arranged differently, for example with a bayonet coupling rather than a simple bearing force; and/or the telescopic tubular unit is different from the slide 46, with, for example, a T-shape rather than an L-shape.

In other variants that are not illustrated, the valves 31 and 36 and the jack 47 are of different type, for example electric instead of pneumatic; the number of perforated gutters 20 is different from seven, for example five; the link pipes between the gutters such as 38 are external to the cage rather than internal to the latter; and/or the pressure agent used is different from compressed air, for example water.

Numerous other variants are possible according to circumstances, and it will be recalled in this respect that the invention is not limited to the examples described and represented.

The invention claimed is:

1. Press for separating solid and liquid parts of matter, comprising:

a cage (2) presenting a cylindrical lateral wall (6) and two flanges (7) closing said cage respectively at one end and at the other end of said lateral wall (6);

means (4, 13-16) for mounting said cage (2) to rotate about its axis (3) in a position where the latter is positioned horizontally, comprising a chassis (4, 14, 16);

means (21-24) for selectively controlling the rotation of said cage (2) about its axis (3);

a deformable flexible membrane (8) positioned in said cage, fixed in a seal-tight manner to the lateral wall (6) of the cage along two opposite longitudinal edges (9) and fixed in a seal-tight manner to the flanges (7) along two respective transversal edges (10) each situated between an end of one longitudinal edge (9) and an end of the other longitudinal edge (9) so that said membrane (8) separates the internal volume of said cage (2) into a pressing chamber (11) delimited by said membrane (8), by a first half of said lateral wall (6) situated between said two opposite longitudinal edges (9) and by a first half of each of said flanges (7) situated, relative to the respective transversal edges (10), on the side of the first half of the lateral wall (6), and into a control chamber (12) delimited by said membrane (8), by the second half of said lateral wall (6) and by the second half of said flanges (7), said flexible membrane (8), at rest, having almost the form of half of the cage (2);

means (13, 17) for admitting a pressure agent into said control chamber (12) and means (13, 18) for sucking said pressure agent out of said control chamber (12);

at least one door (19) blocking or revealing an opening provided in said first half of the lateral wall (6) of the cage (2);

drainage means (20) equipping said first half of the lateral wall (6) of the cage (2); and means for recovering said liquid part of the matter leaving the pressing chamber (11) via said drainage means (20);

wherein said recovery means comprise:

on the cage (2), at least one external racking device (33), and a connection unit (39) through which opens out an outlet orifice (37) of the racking device (33); and on said chassis (4, 14, 16, 42, 43), a liquid taking device (40) comprising a telescopic tubular unit (46) having a retracted position in which said telescopic unit (46) presents no obstacle to the rotation of the cage (2) and an extended position in which said telescopic unit (46) is adapted, when the cage (2) is in a predetermined pressing angular position, to come against said connection unit (39) in a seal-tight bearing manner around the outlet orifice (37) of the racking device (33).

2. Press according to claim 1, wherein said connection unit is a plate (39) projecting radially from the lateral wall (6) whereas said telescopic unit (46) comprises an annular sealing gasket (56) by which said telescopic unit (46) is adapted to come into contact against said plate (39) around said outlet orifice (37).

3. Press according to claim 1, wherein said liquid taking device (40) comprises a guide bushing (45) whereas said telescopic tubular unit is a slide (46) engaged in said bushing (45) with respect to which it slides, the liquid taking device (40) comprising a jack (47) to displace said slide (46) between said retracted position and said extended position.

4. Press according to claim 3, wherein said slide (46) comprises a straight tubular portion (53) engaged in said bushing (45) and provided at one end with a head (55, 56) by which said slide is adapted to bear against said connection unit (39).

5. Press according to claim 4, wherein said head comprises a ring (55) linked to said straight tubular portion (53) and a sealing annular gasket (56) supported by said ring (55) on the side opposite to said tubular portion (53).

6. Press according to claim 4, wherein said liquid taking device (40) comprises a bellows (57) positioned between said guide bushing (45) and said head (55, 56).

7. Press according to claim 4, wherein said slide (46) comprises, in addition to said straight tubular portion (53), called first straight tubular portion, a second straight tubular portion (54) oriented transversally to the first tubular portion (53) and extending from the latter to a coupling for a flexible pipe (51).

8. Press according to claim 1, wherein said racking device (33) comprises a pipe (34) in communication with said drainage means (20) and a valve (36) positioned between said pipe (34) and said outlet orifice (37).

9. Press according to claim 1, wherein said drainage means comprise a plurality of perforated gutters (20) and link means (38) between said perforated gutters (20), said racking device being in communication with a space delimited by said lateral wall (6) and by the gutter (20) which is the lowest in said predetermined pressing angular position.

10. Press according to claim 9, further comprising a plurality of said racking devices (33).

11. Press according to claim 1, wherein said recovery means also comprise a tank (5) positioned on the ground vertically in line with said outlet orifice (37).

12. Press according to claim 1, further comprising an assembly (30) for allowing inert gas into said pressing chamber (11).

13. Press according to claim 2, wherein said liquid taking device (40) comprises a guide bushing (45) whereas said telescopic tubular unit is a slide (46) engaged in said bushing (45) with respect to which it slides, the liquid taking device (40) comprising a jack (47) to displace said slide (46) between said retracted position and said extended position.

14. Press according to claim 5, wherein said liquid taking device (40) comprises a bellows (57) positioned between said guide bushing (45) and said head (55, 56).

15. Press according to claim 5, wherein said slide (46) comprises, in addition to said straight tubular portion (53), called first straight tubular portion, a second straight tubular portion (54) oriented transversally to the first tubular portion (53) and extending from the latter to a coupling for a flexible pipe (51).

16. Press according to claim 6, wherein said slide (46) comprises, in addition to said straight tubular portion (53), called first straight tubular portion, a second straight tubular portion (54) oriented transversally to the first tubular portion (53) and extending from the latter to a coupling for a flexible pipe (51).

* * * * *